US008992657B2

(12) United States Patent
Sawazono et al.

(10) Patent No.: US 8,992,657 B2
(45) Date of Patent: Mar. 31, 2015

(54) MATERIAL FOR DECORATIVE PARTS

(75) Inventors: Yoshimitsu Sawazono, Hyogo (JP); Katsuya Uchino, Hyogo (JP); Yoshihiro Minato, Hyogo (JP)

(73) Assignees: Sumitomo Electric Hardmetal Corp., Hyogo (JP); Sumitomo Electric Industries, Ltd., Osaka (JP)

( * ) Notice: Subject to any disclaimer, the term of this patent is extended or adjusted under 35 U.S.C. 154(b) by 262 days.

(21) Appl. No.: 13/702,776

(22) PCT Filed: Feb. 23, 2012

(86) PCT No.: PCT/JP2012/054453

§ 371 (c)(1), (2), (4) Date: Dec. 7, 2012

(87) PCT Pub. No.: WO2012/121023

PCT Pub. Date: Sep. 13, 2012

(65) Prior Publication Data

US 2013/0087019 A1 Apr. 11, 2013

(30) Foreign Application Priority Data

Mar. 7, 2011 (JP) ..... 2011-049695

(51) Int. Cl.

*C22C 29/02* (2006.01)
*C22C 29/06* (2006.01)
*B22F 3/15* (2006.01)

(52) U.S. Cl.

CPC ..... *C22C 29/067* (2013.01); *C22C 29/02* (2013.01); *B22F 3/15* (2013.01)
USPC ..... 75/237; 75/238; 75/242

(58) Field of Classification Search

USPC ..... 75/237, 238; 501/96.1
See application file for complete search history.

(56) References Cited

U.S. PATENT DOCUMENTS

| | | | | |
|---|---|---|---|---|
| 3,958,070 | A * | 5/1976 | Schintlmeister et al. | 428/408 |
| 4,983,212 | A * | 1/1991 | Iyori et al. | 75/238 |
| 5,723,800 | A * | 3/1998 | Yoshimoto et al. | 75/238 |
| 6,277,486 | B1 * | 8/2001 | Matsubara | 428/336 |
| 6,379,798 | B1 * | 4/2002 | Yazaki | 428/408 |
| 7,413,591 | B2 * | 8/2008 | Tokunaga | 75/244 |

FOREIGN PATENT DOCUMENTS

| | | | |
|---|---|---|---|
| EP | 0 374 358 | A1 | 6/1990 |
| EP | 0 495 101 | A1 | 7/1992 |
| JP | 03-068739 | A | 3/1991 |
| JP | 04-47020 | B2 | 7/1992 |
| JP | 04-47021 | B2 | 7/1992 |
| JP | 06-228701 | A | 8/1994 |
| JP | 2003-013154 | A | 1/2003 |
| JP | 2009-029669 | A | 2/2009 |
| JP | 2010031308 | A | 2/2010 |
| JP | 2010-275576 | A | 12/2010 |
| WO | WO 2008/111652 | A1 | 9/2008 |

OTHER PUBLICATIONS

Extended European Search Report for corresponding European Application No. 1275504.4, dated Aug. 5, 2014, 6 pages.

Yang et al., "Effect of partial substitution of Cr for Ni on densification behavior, microstructure evolution and mechanical properties of Ti(C,N)-Ni-based cermets", Journal of Alloys and Compounds, vol. 509, No. 14, Jan. 27, 2011, pp. 4828-4834.

International Search Report for PCT/JP2012/054453 dated May 12, 2007, pp. 1-2.

Extended European Search Report for corresponding European Application No. 12755004.4, dated Aug. 5, 2014, 6 pages.

International Search Report for PCT/JP2012/054453 dated May 22, 2007, pp. 1-2.

International Search Report for PCT/JP2012/054453 dated May 22, 2012, pp. 1-2.

* cited by examiner

*Primary Examiner* — George Wyszomierski
*Assistant Examiner* — Ngoclan T Mai
(74) *Attorney, Agent, or Firm* — Ditthavong & Steiner, P.C.

(57) ABSTRACT

A lightweight material for decorative parts having a silver metallic color tone is provided. The material includes a sintered body including a main hard phase composed of a solid solution formed of titanium carbonitride and titanium carbide; a main binder phase composed of nickel; a first additive material composed of at least one selected from the group consisting of molybdenum carbide, niobium carbide, tungsten carbide, and tantalum carbide; a second additive material composed of at least one of chromium and chromium carbide; and the balance being incidental impurities. The N content in the sintered body is 2.0% to 6.0% by mass. The color tone of the sintered body satisfies L*=9 to 14, a*=−2 to 3, and b*=−6 to 0, which are values of the L*a*b* color system measured with a spectrophotometric colorimeter.

4 Claims, 2 Drawing Sheets

MATERIAL FOR DECORATIVE PARTS

TECHNICAL FIELD

The present invention relates to a material for decorative parts that is suitable for casings for watches and external housings of various electronic devices. In particular, the present invention relates to a material for decorative parts including a sintered body having a silver metallic color tone.

BACKGROUND ART

In terms of color tone and corrosion resistance, stainless steel, a cemented carbide including a main hard phase composed of tungsten carbide, and a coated member obtained by plating a metal substrate have been used for decorative parts having a silver metallic color tone.

However, stainless steel is easily scratched by contact with a hard material. A cemented carbide has a higher specific gravity than a metal material such as stainless steel and thus the weight of products is increased. A coated member also does not necessarily have sufficient scratch resistance or wear resistance. In addition, the constituent elements of the plating react with sweat and are leached out, which may result in metal allergy.

Therefore, the ceramic materials disclosed in PTLs 1 to 6 have been proposed to address the problems above.

CITATION LIST

Patent Literature

PTL 1: Japanese Examined Patent Application Publication No. 4-47020

PTL 2: Japanese Examined Patent Application Publication No. 4-47021

PTL 3: International Publication No. 2008/111652

PTL 4: Japanese Unexamined Patent Application Publication No. 6-228701

PTL 5: Japanese Unexamined Patent Application Publication No. 2003-13154

PTL 6: Japanese Unexamined Patent Application Publication No. 2009-29669

SUMMARY OF INVENTION

Technical Problem

The ceramic materials for decorative parts disclosed in PTLs 1 to 3 each have a gold color tone. However, a gold color restricts the design variation of products, and therefore a silver metallic color tone is desired.

PTL 4 discloses a silver sintered alloy including a main hard phase composed of titanium carbide. However, titanium carbide readily undergoes discoloration due to corrosion, has low sinterability, and easily causes defects such as voids in a sintered microstructure. The surface of watch and jewelry parts often needs to be subjected to mirror finishing so as to have a beautiful shine in view of the nature thereof. Therefore, a material in which microstructural defects are easily formed is not suitable as a material to be subjected to mirror finishing.

PTL 5 discloses a sintered alloy in which a hard phase composed of titanium nitride and titanium carbide serves as a main hard phase. The sintered alloy has a color tone which is a combination of a silver color and any color ranging from purple to pink. The color tone changes depending on the mixing state of the two components in the hard phase and does not look luxurious.

PTL 6 discloses a decorative part for fishing line guides and watches, the decorative part including a main hard phase composed of titanium carbonitride. However, such a part has a reddish silver color tone and thus the design variation of products is restricted.

Accordingly, it is an object of the present invention to provide a lightweight material for decorative parts having a silver metallic color tone.

It is an another object of the present invention to provide a material for decorative parts that has a small number of defects in a microstructure and is suitable for mirror finishing.

It is an another object of the present invention to provide a nonmagnetic material for decorative parts having good corrosion resistance.

Solution to Problem

A material for decorative parts of the present invention includes a sintered body that includes a main hard phase composed of a solid solution formed of titanium carbonitride and titanium carbide, a main binder phase composed of nickel, a first additive material composed of at least one selected from the group consisting of molybdenum carbide, niobium carbide, tungsten carbide, and tantalum carbide, a second additive material composed of at least one of chromium and chromium carbide, and the balance being incidental impurities. The N content in the sintered body is 2.0% to 6.0% by mass. The color tone of the sintered body satisfies the following values of an L*a*b* color system measured with a spectrophotometric colorimeter.

$L^*=9$ to 14

$a^*=-2$ to 3

$b^*=-6$ to 0

According to this configuration, a material for decorative parts having a silver metallic color tone can be provided. In particular, a material for decorative parts that looks luxurious and has a beautiful dark silver metallic luster and a fine microstructure including a small number of cavities and a small amount of segregation in the binder phase can be provided.

In an embodiment of the material for decorative parts according to the present invention, the specific gravity of the sintered body is 5.5 to 7.5.

According to this configuration, the sintered body is lighter than stainless steel, which has a specific gravity of about 7.7 to 8.0. The weight of products produced from this material can be reduced.

In an embodiment of the material for decorative parts according to the present invention, the sintered body is a nonmagnetic sintered body.

According to this configuration, the material can be used as a material for decorative parts that need to have nonmagnetism, such as a casing for watches.

In an embodiment of the material for decorative parts according to the present invention, the content of nickel serving as the main binder phase is 10% by mass or more and 15% by mass or less, and the content of the first additive material is 8.0% by mass or more and 15.0% by mass or less.

According to this configuration, a material for decorative parts having good corrosion resistance can be provided.

In an embodiment of the material for decorative parts according to the present invention, the porosity of the sintered body is A-2 class or higher provided in ANSI/ASTM B276-54.

According to this configuration, a sintered body having a small number of microstructural defects such as voids can be provided, and a material for decorative parts that is suitable for mirror finishing can be provided.

Advantageous Effects of Invention

According to the material for decorative parts of the present invention, a lightweight material for decorative parts having a silver metallic color tone can be provided.

DESCRIPTION OF EMBODIMENTS

Figure 1:
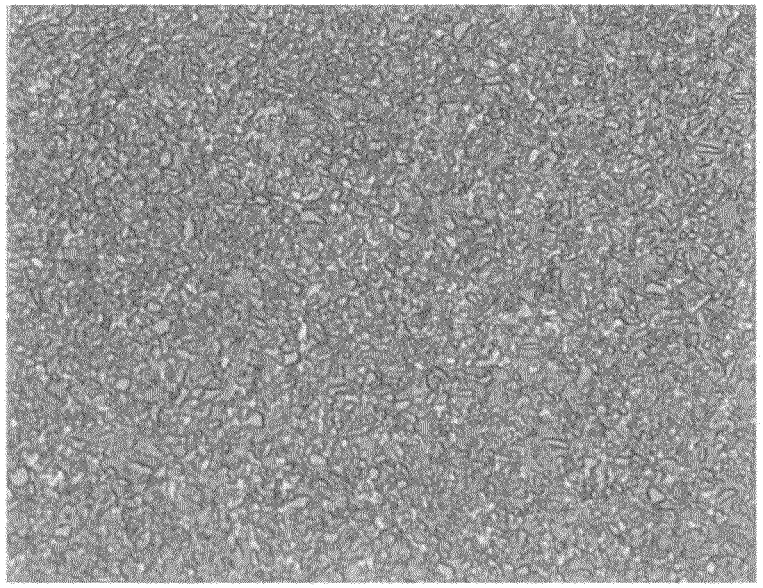
FIG. 1 is a photomicrograph of a microstructure of Sample No. 6 in a test example.
Figure 2:
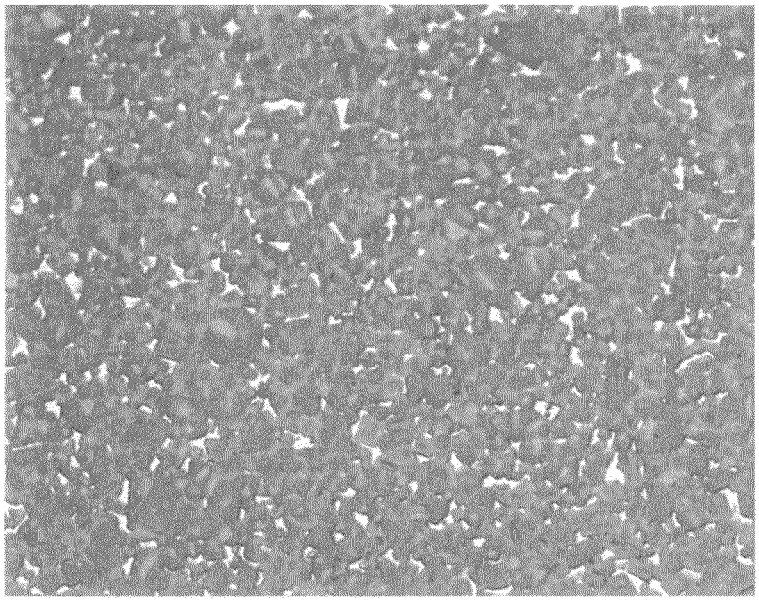
FIG. 2 is a photomicrograph of a microstructure of Sample No. 1 in a test example.
Figure 3:
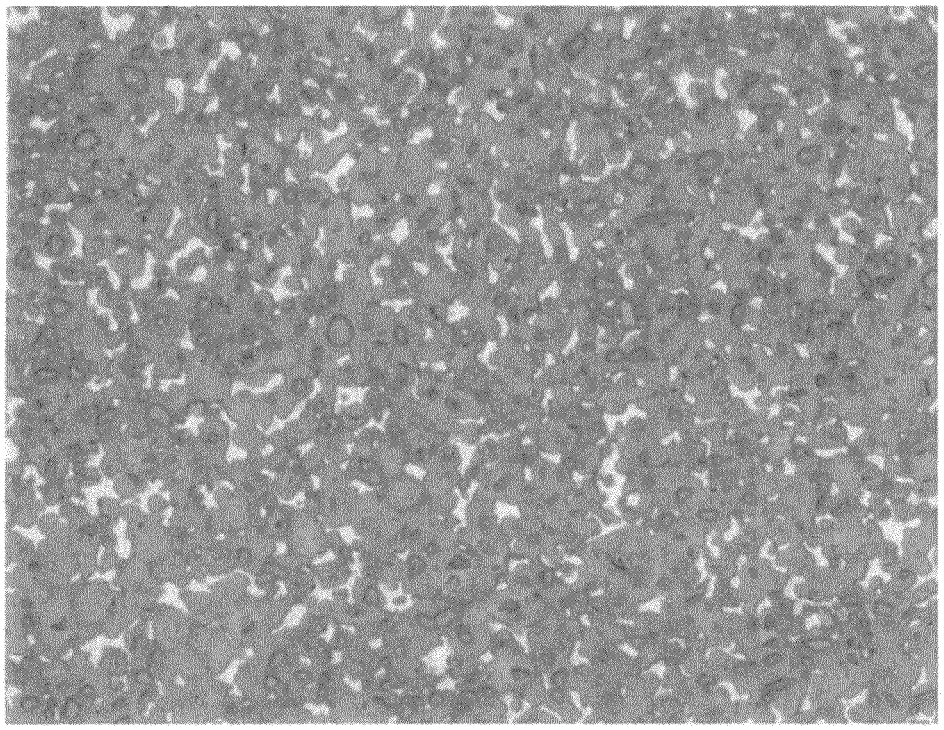
FIG. 3 is a photomicrograph of a microstructure of Sample No. 9 in a test example.

An embodiment of the present invention will now be described.

[Material for Decorative Parts]

This material includes a sintered body that includes a main hard phase, a main binder phase, a first additive material, and a second additive material. Hereinafter, each of the components is described in detail.

[Main Hard Phase]

The main hard phase is a component that accounts for 60% by mass or more of a sintered body and mainly contributes to ensuring the hardness of a material for decorative parts. The main hard phase is composed of a solid solution formed of titanium carbonitride and titanium carbide. By adjusting the balance of, for example, the brown or gray gold color tone of titanium carbonitride with a metallic luster, the black color of titanium carbide, and the silver color of nickel serving as a first additive material, a silver metallic color tone, in particular, a dark silver metallic color tone can be produced.

The titanium carbonitride in the main hard phase also contributes to the control of a N content in the sintered body. The content of the titanium carbide in the main hard phase is preferably 20% to 50% by mass. The lower limit is set to be 20% by mass because a silver metallic color tone but not a gold color tone is easily obtained. The upper limit is set to be 50% by mass because titanium carbide easily ignites in the high-temperature air and has low sinterability, and an excessively high content of titanium carbide easily causes microstructural defects such as cavities. The content of the titanium carbide in the main hard phase is particularly preferably 30% to 50% by mass.

The average grain size in the main hard phase is preferably 3 μm or less and more preferably 1 μm or less. Such a hard phase having a fine sintered microstructure is suitable for a material that has high hardness and good scratch resistance, has a small number of microstructural defects, and is subjected to mirror finishing.

[Main Binder Phase]

The main binder phase functions as a binder that binds crystals of the main hard phase, in particular, titanium carbonitride and other additive materials. The main binder phase is composed of nickel. In addition to the function as a binder, nickel improves the corrosion resistance of a material for decorative parts together with chromium serving as a second additive material and contributes to providing a nonmagnetic material.

The content of nickel in the material for decorative parts is preferably 7% to 15% by mass. When the lower limit is 7% by mass, the main hard phases can be properly bound and a dense material for decorative parts having an appropriate toughness can be provided. When the upper limit is 15% by mass, a decrease in the hardness of the material for decorative parts can be suppressed. The content of nickel is more preferably 10% to 15% by mass.

The total content of the main binder phase, a first additive material described below, and a second additive material described below is less than 40% by mass. Within the range, the contents of the main binder phase and first additive material may be the same.

(First Additive Material)

The first additive material functions as a reinforcing phase of the material for decorative parts and also functions as a color controlling material. The first additive material is composed of at least one carbide selected from the group consisting of molybdenum carbide, niobium carbide, tungsten carbide, and tantalum carbide.

In general, these carbides are not dissolved in titanium nitride and coexist with titanium carbide as the peripheral microstructure of the titanium nitride. Part of the carbides is decomposed into a metal component and carbon and dissolved in nickel. When a carbon atom is taken in a nickel crystal, the melting point of nickel serving as a main binder phase is decreased, resulting in a decrease in the sintering temperature. At the same time, the wettability between titanium carbide and nickel is improved. Therefore, the sinterability is improved and a sintered body having a small number of microstructural defects such as cavities can be obtained.

Since the first additive material suppresses the grain growth of the main hard phase, the number of grain boundaries increases. The light incident upon the surface of a sintered body is strongly affected by specular reflection due to the crystals constituting the surface and diffuse reflection due to the grain boundaries. As a result, the first additive material mainly contributes to an increase in the lightness index L* among values of the L*a*b* color system. The function of the first additive material as a grain growth-suppressing material contributes to achieving a fine microstructure of the sintered body, and thus also contributes to providing a dense sintered body having a high hardness and a small number of microstructural defects.

The content of the first additive material is preferably 8% to 15% by mass. When the lower limit is 8% by mass, the first additive material can properly function as the above-described reinforcing phase and color-controlling material. When the upper limit is 15% by mass, the weight of a sintered body can be reduced.

(Second Additive Material)

The second additive material is composed of at least one of chromium and chromium carbide. At least part of chromium functions as a binder phase together with nickel in the form of a metal and, at the same time, suppresses the elution of nickel and contributes to an improvement in the corrosion resistance. Chromium also contributes to a reduction in the weight of a sintered body because chromium has a lower specific gravity than nickel. At least part of chromium carbide is decomposed into chromium and carbon during sintering and the chromium is dissolved in nickel serving as the binder phase. As a result, the elution of nickel is also suppressed and the corrosion resistance is improved. Furthermore, chromium carbide contributes to a reduction in the weight of a sintered body because chromium carbide has a lower specific gravity than chromium.

The content of the at least one of chromium and chromium carbide is preferably 2% to 5% by mass. When the lower limit is 2% by mass, the corrosion resistance can be improved. When the upper limit is 5% by mass, a fine microstructure is obtained, and a silver metallic color tone, in particular, a shiny dark silver metallic color tone can be achieved.

(N Content)

The N content in the sintered body is 2.0% to 6.0% by mass. By restricting the N content, a beautiful shiny surface with a dark silver metallic color tone is easily obtained and the corrosion resistance is easily maintained. The N content can be measured with an oxygen/nitrogen analyzer.

(Incidental Impurity)

Silicon, phosphorus, sulfur, manganese, iron, and the like are exemplified as incidental impurities, and they may affect the color tone of the surface of a sintered body. Therefore, the content of each of the elements is suitably 1% by mass or less.

(Values of L*a*b* Color System)

The color tone of the surface of a sintered body that forms the material for decorative parts satisfies the following values of the L*a*b* color system measured with a spectrophotometric colorimeter.

L*=9 to 14 a*=−2 to 3 b*=−6 to 0

L* indicates the lightness (L*=0 indicates black, L*=100 indicates diffuse white), a* is a red to green index, and b* is a yellow to blue index. As the value of L* increases, brightness increases. As the positive value of a* increases, a red color component is intensified. As the negative value of a* increases, a green color component is intensified. As the positive value of b* increases, a yellow color component is intensified. As the negative value of b* increases, a blue color component is intensified.

By satisfying the above-described values, a material for decorative parts having a silver metallic color tone can be obtained. In particular, a material for decorative parts having a dark silver metallic color tone can be obtained. Each of the values of a* and b* is preferably a negative value.

(Specific Gravity)

In general, the material for decorative parts preferably has a low weight. Therefore, the specific gravity of a sintered body is preferably 5.5 to 7.5. When the specific gravity is within the range, a considerably low weight is achieved compared with the case where a cemented carbide is used. In particular, the specific gravity is suitably 6.0 or less. A sintered body having a specific gravity of 6.0 or less is lighter than stainless steel.

(Magnetic Properties)

The material for decorative parts is preferably a nonmagnetic material. This is because, in the case where, for example, a casing for watches is made using the material for decorative parts and precision units such as a movement are housed in the casing, the performance accuracy of the precision units needs to be prevented from being affected as much as possible. A nonmagnetic sintered body can be obtained by, for example, adding nickel and at least one of chromium and chromium carbide in certain amounts.

(Hardness)

The material for decorative parts preferably has a Vickers hardness (Hv) of 8 GPa or more for the purpose of achieving sufficiently high scratch resistance. The hardness is more preferably 12 GPa or more and particularly preferably 15 GPa or more.

(Bending Strength)

The bending strength of the material for decorative parts is preferably 1.2 GPa or more for the purpose of achieving sufficiently high toughness of parts made of the material. The bending strength is more preferably 1.5 GPa or more and particularly preferably 2.0 GPa or more.

(Surface Roughness)

Regarding the surface roughness of the material for decorative parts, an arithmetic mean height (Ra) of 0.05 μm to 0.25 μm is preferably satisfied. With such a mirror surface, various decorative parts having a luxurious shine can be provided. Such a mirror surface can be obtained by performing lapping with a lapping machine.

(Application)

The material for decorative parts of the present invention can be suitably applied to decorative parts for costume jewelry, decorative parts for watches, decorative parts for mobile devices, decorative parts for building materials, and decorative parts for household articles. Examples of the decorative parts for costume jewelry include a ring, a brooch, a necklace, earrings, a tiepin, a tie tack, a button, a bracelet, and a pendant. Examples of the decorative parts for watches include a casing for watches and band links. Examples of the decorative parts for mobile devices include operation buttons such as number keys and input keys, a casing, and a frame component for fixing a display of mobile devices including mobile communication devices/terminals (e.g., cellular phones, PHS, and broadcasting receivers) and mobile information devices/terminals (e.g., cameras, portable AV devices, calculators, portable computers, PDAs, and electronic dictionaries). Examples of the decorative parts for building materials include tiles for decorating a floor, a wall, and a ceiling and a door knob. Examples of the decorative parts for household articles include decorative parts for kitchenware such as spoons and forks.

[Method for Producing Material for Decorative Parts]

The material for decorative parts can be produced through, for example, the steps of preparation of raw materials→mixing of the raw materials→molding→debinding→sintering. Each of the steps is further described in detail.

(Preparation of Raw Materials)

In the step of preparing raw materials, raw material powders of the main hard phase, main binder phase, first additive material, and second additive material are prepared. The average grain size of the raw material powder of the main hard phase is preferably about 1 to 5 μm. The average grain size of the raw material powder of the main binder phase (nickel) is preferably about 1 to 5 μm. The average grain size of the raw material powder of the first additive material (carbide) is preferably about 3 to 8 μm. The average grain size of the raw material powder of the second additive material (at least one of chromium and chromium carbide) is preferably about 3 to 8 μm. When the average grain sizes are within the above-described ranges, such raw material powders can be somewhat easily handled as powder, the mixing described below can be relatively easily performed, and a fine microstructure is easily formed by sintering.

[Mixing of Raw Materials]

The raw material powders described above are mixed using suitable mixing means such as a ball mill as uniformly as possible. In general, the raw material powders are mixed and pulverized together with an organic solvent such as ethanol or methanol. Subsequently, a binder is added to the mixed raw material powders, and granulation is performed by spray drying with drying means such as a spray dryer. Examples of the binder include paraffin wax and polyethylene glycol. The content of the binder is preferably about 2% to 4% by mass relative to the total amount of the raw material powders and binder.

(Molding)

In the molding, a die is filled with the raw material powders subjected to the mixing step above, and the raw material powders are molded into a predetermined shape at a predetermined pressure. Examples of the molding method include dry press molding, cold isostatic molding, injection molding, and extrusion molding. The pressure during the molding is preferably about 10 to 15 MPa. The molded body can have an adequate shape, which is not an excessively complicated shape, depending on the shape of required parts. If necessary, appropriate machining may be performed after sintering to form the final shape of parts.

[Debinding]

In the debinding step, the molded body is heated to remove the binder. This heat treatment is preferably performed at a temperature at which the binder can be vaporized, for example, at about 500° C. to 600° C. The atmosphere is suitably an atmosphere containing inert gas such as nitrogen.

(Sintering)

In the sintering step, the molded body subjected to the debinding is heated to and held at a predetermined temperature to produce a sintered body. The sintering temperature is preferably 1200° C. to 1800° C. and particularly preferably about 1300° C. to 1600° C. At such a temperature, the molded body is sufficiently sintered and a sintered body having a high relative density is obtained. The practical holding time at the heating temperature is about one hour to two hours. The atmosphere during the heating is preferably an atmosphere containing inert gas such as nitrogen or argon or a vacuum atmosphere (about 0.1 to 0.5 Pa). After the sintering, HIP (hot isostatic pressing) may be further performed to obtain a denser sintered body.

Example 1

Samples including samples of Examples of the present invention were prepared and evaluated. After raw material powders were mixed with each other at the ratio shown in Table I, ethanol was added as an organic solvent to the raw material powders and the raw material powders were mixed and pulverized with a ball mill for 15 hours. Subsequently, paraffin wax was added as a binder and spray drying was performed using a spray dryer to prepare a mixed powder. The resultant powder was molded into a predetermined shape by being compacted at 12 MPa by dry press molding. Next, the molded body was subjected to debinding in a nitrogen atmosphere at 600° C. and then subjected to machining when necessary. The molded body was then sintered by being held in a vacuum at 0.5 Pa at 1420° C. for one hour. Furthermore, the resultant sintered body was subjected to a high temperature and pressure HIP treatment at 1380° C. to obtain a sintered body having a relative density of 95% or more.

The sintered body was processed with a lapping machine and then subjected to barrel polishing to achieve a mirror finish that satisfied an arithmetic mean height (Ra) of 0.05 μm to 0.25 μm, which is provided in JIS B 0601-2001.

The specific gravity, bending strength, Vickers hardness (Hv), magnetic properties, corrosion resistance, color tone, mirror surface state, and N content of the obtained samples were measured. An apparent density was measured as the specific gravity in conformity with JIS R 1634-1998. The bending strength was measured in conformity with a three-point bending test method of JIS R 1601-2008. The Vickers hardness (Hv) was measured in conformity with a test method of JIS Z 2244-2009. The corrosion resistance was evaluated by a Ni elution test. The Ni elution test was performed in accordance with N34 TC 283 Precious metals-Applications in jewelry and associated Products WG4 Health and safety aspects with special reference to Nickel Allergy Secretariat: SIS (Sweden). The magnetic properties were evaluated by measuring the saturation magnetization. The color tone of a surface of each sample was measured with a spectrophotometric colorimeter (CM-3700d manufactured by KONICA MINOLTA HOLDINGS, INC.) at a viewing angle of 10° using CIE standard light source D65 as a light source in conformity with JIS Z 8722-2000. The mirror surface state was evaluated on the basis of the void level in a field of view magnified by 200 times with a metallurgical microscope and by determining whether or not the porosity provided in ANSI/ASTM B276-54 was A-2 class or higher. In the mirror surface state, the presence of cavities or segregation of nickel serving as a binder phase and cobalt in a microstructure of the sintered body causes depressions of a surface. Regarding the void level, "Good" was given when the number of depressions per square centimeters was 0 and "Fair" was given when the number of depressions per square centimeters was 1 to 3. The N content was measured with an oxygen/nitrogen analyzer manufactured by LECO JAPAN CORPORATION. Table II shows the results.

TABLE I

| Sample | Mixing composition (% by mass) | | | | | | | | |
|---|---|---|---|---|---|---|---|---|---|
| No. | * | TiCN | TiC | $Mo_2C$ | Ni | Cr | Co | Other | $Cr_3C_2$ |
| 1 | * | — | 72 | 10 | 14 | 4 | — | — | — |
| 2 | * | 72 | — | 10 | 14 | 4 | — | — | — |
| 3 | * | 18 | 54 | 10 | 14 | 4 | — | — | — |
| 4 | | 24 | 48 | 10 | 14 | 4 | — | — | — |
| 5 | | 36 | 36 | 10 | 14 | 4 | — | — | — |
| 6 | | 48 | 24 | 10 | 14 | 4 | — | — | — |
| 7 | * | — | 62 | 10 | 12 | 3 | 3 | WC: 10 | — |
| 8 | * | — | 52 | 10 | 12 | 3 | 3 | WC: 20 | — |
| 9 | * | — | 42 | 10 | 12 | 3 | 3 | WC: 30 | — |
| 10 | | 24 | 47.4 | 10 | 14 | — | — | — | 4.6 |
| 11 | | 36 | 35.4 | 10 | 14 | — | — | — | 4.6 |
| 12 | | 48 | 23.4 | 10 | 14 | — | — | — | 4.6 |

* Comparative Example

TABLE II

| Sample | Specific | Resisting force | Vickers hardness | Magnetic properties | Ni elution test | Color tone | | | Mirror surface state | | N content |
|---|---|---|---|---|---|---|---|---|---|---|---|
| No. | gravity | (GPa) | (GPa) | (Gauss/cm²/g) | (μg/cm²/week) | L* | a* | b* | Void level | Porosity | (mass %) |
| 1* | 5.6 | 1.4 | 15.5 | 0 | 0.42 | | | | Fair | A02, B02 | 0.02 |
| 2* | 6.0 | 1.8 | 15.3 | 0 | 0.33 | Gold color tone | | | Good | A02, B02 | 7.50 |
| 3* | 5.9 | 1.4 | 15.4 | 0 | 0.38 | | | | Fair | A02 | 1.70 |
| 4 | 5.8 | 1.6 | 15.8 | 0 | 0.35 | 11.07 | −0.57 | −2.17 | Good | A02 | 2.43 |
| 5 | 5.7 | 1.8 | 15.4 | 0 | 0.17 | 12.54 | −0.56 | −3.21 | Good | A02 | 3.60 |
| 6 | 5.7 | 2.2 | 15.3 | 0 | 0.18 | 13.09 | −0.6 | −3.23 | Good | A02 | 5.51 |
| 7* | 6.3 | 1.7 | 15.2 | 1 | 0.42 | | | | Fair | A02, B02 | 0.08 |

TABLE II-continued

| Sample No. | Specific gravity | Resisting force (GPa) | Vickers hardness (GPa) | Magnetic properties (Gauss/cm²/g) | Ni elution test (μg/cm²/week) | Color tone L* | Color tone a* | Color tone b* | Mirror surface state Void level | Mirror surface state Porosity | N content (mass %) |
|---|---|---|---|---|---|---|---|---|---|---|---|
| 8* | 6.6 | 1.7 | 15.1 | 3 | 0.42 | | | | Fair | A02, B02 | 0.06 |
| 9* | 7.3 | 1.8 | 14.5 | 5 | 0.78 | | | | Fair | A02, B02 | 0.05 |
| 10 | 5.8 | 1.6 | 15.8 | 0 | 0.34 | 11.07 | −0.57 | −2.17 | Good | A02 | 2.39 |
| 11 | 5.7 | 1.8 | 15.4 | 0 | 0.18 | 12.54 | −0.56 | −3.21 | Good | A02 | 3.64 |
| 12 | 5.7 | 2.2 | 15.3 | 0 | 0.19 | 13.09 | −0.6 | −3.23 | Good | A02 | 5.60 |

*Comparative Example

As shown in Table II, Sample Nos. 4 to 6 and 10 to 12 were nonmagnetic materials having a specific gravity of 6.0 or less, a bending strength of 1.6 GPa or more, a Vickers hardness of 15.0 GPa or more, a Ni elution amount of 0.35 μg/cm² or less, and a dark silver metallic color tone. Regarding the mirror surface state, the number of voids was small and the porosity provided in ANSI/ASTM was A-2 class or higher.

In particular, Sample Nos. 5, 6, 11, and 12 in which the ratio of TiC in the main hard phase was 30% by mass or more and 50% by mass or less had a high bending strength and a considerably small Ni elution amount. As is clear from FIG. 1, the microstructure of Sample No. 6 is a very fine microstructure.

Sample Nos. 4 to 6 were samples whose second additive material was chromium whereas Sample Nos. 10 to 12 were samples whose second additive material was chromium carbide. As is clear from the comparison between the samples having substantially the same composition (e.g., Sample No. 4 and Sample No. 10), the samples have the same properties in terms of alloy properties, the level of alloy cavities, and color tone.

Sample No. 1 whose main hard phase was composed of only TiC had an insufficient mirror surface state. This may be because the sinterability was low. Sample No. 2 whose main hard phase was composed of only TiCN had a gold color tone and thus a silver metallic color tone was not achieved. Sample No. 3 in which the main hard phase was composed of TiCN and TiC but the TiCN content was low had an insufficient mirror surface state.

Sample Nos. 7 to 9 containing WC and Co had a high specific gravity of more than 6.0, a large Ni elution amount, and an insufficient mirror surface state.

The present invention is not limited to the above-described embodiments and can be suitably modified without departing from the scope of the present invention.

INDUSTRIAL APPLICABILITY

The material for decorative parts of the present invention can be suitably applied to decorative parts for costume jewelry, decorative parts for watches, decorative parts for mobile devices, decorative parts for building materials, religious craft products, and decorative parts for household articles.

The invention claimed is:

1. A material for decorative parts comprising a sintered body that includes:

a main hard phase composed of a solid solution formed of titanium carbonitride and titanium carbide;

a main binder phase composed of nickel;

a first additive material composed of at least one selected from the group consisting of molybdenum carbide, niobium carbide, tungsten carbide, and tantalum carbide;

a second additive material composed of at least one of chromium and chromium carbide; and a balance being incidental impurities, wherein:

a N content in the sintered body is 2.0% to 6.0% by mass, a color tone of the sintered body satisfies the following values of an L*a*b* color system measured with a spectrophotometric colorimeter:

L*=9 to 14, a*=−2 to 3, and b*=−6 to 0, a content of nickel serving as the main binder phase is 10% by mass or more and 15% by mass or less, and a content of the first additive material is 8.0% by mass or more and 15.0% by mass or less.

2. The material for decorative parts according to claim 1, wherein a specific gravity of the sintered body is 5.5 to 7.5.

3. The material for decorative parts according to claim 1, wherein the sintered body is a nonmagnetic sintered body.

4. The material for decorative parts according to claim 1, wherein a porosity of the sintered body is A-2 class or higher provided in ANSI/ASTM B276-54.

* * * * *